US012467251B2

(12) United States Patent
Förg

(10) Patent No.: US 12,467,251 B2
(45) Date of Patent: Nov. 11, 2025

(54) SEALING DEVICE FOR EDGE JOINTS AND DRYWALL

(71) Applicant: Hilti Aktiengesellschaft, Schaan (LI)

(72) Inventor: Christian Förg, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 77 days.

(21) Appl. No.: 18/042,467

(22) PCT Filed: Aug. 20, 2021

(86) PCT No.: PCT/EP2021/073160
§ 371 (c)(1),
(2) Date: Feb. 22, 2023

(87) PCT Pub. No.: WO2022/043218
PCT Pub. Date: Mar. 3, 2022

(65) Prior Publication Data

US 2023/0323657 A1 Oct. 12, 2023

(30) Foreign Application Priority Data

Aug. 24, 2020 (EP) ..... 20192384

(51) Int. Cl.
*E04B 1/68* (2006.01)
*E04B 1/94* (2006.01)
(Continued)

(52) U.S. Cl.
CPC ..... *E04B 1/6813* (2013.01); *E04B 1/947* (2013.01); *E04B 1/948* (2013.01); *E04F 13/06* (2013.01);
(Continued)

(58) Field of Classification Search
CPC ..... E04B 1/6813; E04B 1/947; E04B 1/948; E04B 2/7872; E04B 2/285; E04B 13/06;
(Continued)

(56) References Cited

U.S. PATENT DOCUMENTS 3,368,312 A * 2/1968 Shore ..... E04B 2/825 52/241
3,606,712 A * 9/1971 Moir ..... E04F 19/06 52/35
(Continued)

FOREIGN PATENT DOCUMENTS

GB 2105762 A * 3/1983 ..... E04B 2/825

OTHER PUBLICATIONS

Förg et al., U.S. Appl. No. 18/041,664, filed Feb. 14, 2023.
(Continued)

*Primary Examiner* — Robert Canfield
(74) *Attorney, Agent, or Firm* — Grüneberg and Myers PLLC

(57) ABSTRACT

A sealing device can be used for an edge joint between a cladding part of drywall and an adjacent floor, wall, or ceiling. The sealing device contains a one-piece base body having a carrier portion, a contact portion, and a sealing portion. The carrier portion forms a support for the circumferential side of the cladding part. The contact portion starts from the carrier portion and protrudes in a first direction angled with respect to the carrier portion in order to rest against an edge of an end face of the cladding part. The sealing portion starts from the carrier portion and extends away from the carrier portion. The sealing portion has two spaced apart webs that bridge the edge joint. Furthermore, drywall can have at least one cladding part and a sealing device of this type.

15 Claims, 4 Drawing Sheets

(51) Int. Cl.

| | |
|---|---|
| ***E04B 2/74*** | (2006.01) |
| ***E04B 2/78*** | (2006.01) |
| ***E04F 13/06*** | (2006.01) |
| ***E04F 19/04*** | (2006.01) |
| ***E04F 19/06*** | (2006.01) |

(52) U.S. Cl.
CPC ..... *E04F 19/0436* (2013.01); *E04F 19/064* (2013.01); *E04B 2/7872* (2013.01)

(58) Field of Classification Search
CPC ..... E04B 13/26; E04B 2013/065; E04B 19/0436; E04B 19/06; E04B 19/061; E04B 19/049; E04B 19/064; E04B 19/065
See application file for complete search history.

(56) References Cited

U.S. PATENT DOCUMENTS 4,622,791 A * 11/1986 Cook ..... E04B 2/825 52/288.1
4,671,026 A * 6/1987 Wissinger ..... A47K 3/16 52/287.1
4,899,510 A * 2/1990 Propst ..... E04B 2/825 52/582.2
D324,575 S * 3/1992 Davis ..... D25/119
5,312,672 A * 5/1994 Dittmeier ..... B32B 1/08 428/192
5,765,332 A * 6/1998 Landin ..... E04B 1/948 52/235
7,617,643 B2 * 11/2009 Pilz ..... E04B 2/76 52/232
8,640,415 B2 2/2014 Pilz et al.
8,689,507 B2 * 4/2014 Chandler ..... E02D 31/02 52/287.1
8,793,947 B2 8/2014 Pilz et al.
8,955,277 B1 * 2/2015 Joye ..... E04B 2/7457 52/302.1
9,290,932 B2 3/2016 Pilz et al.
9,663,944 B1 * 5/2017 Lam ..... E04B 2/02
9,683,364 B2 6/2017 Pilz et al.
10,087,616 B1 * 10/2018 Lam ..... E04B 2/02
10,184,246 B2 1/2019 Pilz et al.
10,487,497 B1 * 11/2019 Aitken ..... E04F 13/14
10,870,995 B1 * 12/2020 Meeks ..... E04F 19/049
11,060,283 B2 7/2021 Pilz et al.
11,905,705 B2 2/2024 Pilz et al.
2005/0155317 A1 7/2005 Frezza
2005/0229515 A1 * 10/2005 Ruston ..... E04B 2/82 52/302.1
2010/0024339 A1 2/2010 Tamlyn et al.
2013/0126694 A1 * 5/2013 Kline ..... E04F 19/061 248/346.5
2016/0130802 A1 * 5/2016 Pilz ..... E04B 1/948 52/483.1
2016/0208484 A1 * 7/2016 Pilz ..... E04B 2/7411
2016/0262576 A1 * 9/2016 Kratzmann ..... A47K 3/40
2017/0328057 A1 11/2017 Pilz
2020/0199869 A1 * 6/2020 Simonic ..... E04B 2/7411
2020/0240140 A1 7/2020 Pilz
2021/0355693 A1 * 11/2021 Finley ..... E04F 19/064
2023/0304280 A1 * 9/2023 Förg ..... E04B 2/7411
2023/0323656 A1 * 10/2023 Förg ..... E04B 1/6813 52/396.06
2023/0323657 A1 * 10/2023 Förg ..... E04B 1/947 52/232
2023/0332398 A1 * 10/2023 Forg ..... F16J 15/104
2024/0018788 A1 * 1/2024 Holfelder ..... E04F 13/0733
2024/0263440 A1 * 8/2024 Förg ..... E04B 2/7457
2024/0263444 A1 8/2024 Pilz et al.

OTHER PUBLICATIONS

Förg et al., U.S. Appl. No. 18/041,675, filed Feb. 14, 2023.
Förg et al., U.S. Appl. No. 18/042,480, filed Feb. 22, 2023.
Förg et al., U.S. Appl. No. 18/042,498, filed Feb. 22, 2023.
Förg et al., U.S. Appl. No. 18/042,634, filed Feb. 23, 2023.
Förg et al., U.S. Appl. No. 18/042,767, filed Feb. 23, 2023.
U.S. Appl. No. 18/041,664, filed Feb. 14, 2023, Förg et al.
U.S. Appl. No. 18/042,498, filed Feb. 22, 2023, Förg et al.
U.S. Appl. No. 18/041,675, filed Feb. 14, 2023, Förg et al.
U.S. Appl. No. 18/042,634, filed Feb. 23, 2023, Förg et al.
U.S. Appl. No. 18/042,767, filed Feb. 23, 2023, Förg et al.
U.S. Appl. No. 18/042,480, filed Feb. 22, 2023, Förg et al.
International Search Report dated Nov. 5, 2021, in PCT/EP2021/073160, with English translation, 5 pages.
Written Opinion dated Nov. 5, 2021, in PCT/EP2021/073160, with English translation, 9 pages.
Hilti, "Bottom Track Seal CFS-BTS", Product Information, CFS-BTS 5/8" and CFS-BTS 1-1/4", Sep. 2023, 1 page.
Cemco®, "Hotrod® BW Compressible Firestop", Product Description, Feb. 11, 2025, 2 pages.
Cemco®, "Smoke & Sound Stop Blue (SSSB)", Product Description, Feb. 11, 2025, 2 pages.
"XHBN—Joint Systems: XHBN7—Joint Systems Certified for Canada", System No. BW-S-0024, UL Product IQ®, Sep. 6, 2024, 4 pages.
Blaze Foam, Intumescent compressible Firestop Foam, For Head of Wall Applications—Dynamic & Static, Blazing Fast Firestop Installation, RectorSeal, 2018, 2 pages.

* cited by examiner

SEALING DEVICE FOR EDGE JOINTS AND DRYWALL

CROSS-REFERENCE TO RELATED APPLICATIONS

This application is the National Stage entry under § 371 of International Application No. PCT/EP2021/073160, filed on Aug. 20, 2021, and which claims the benefit of priority to European Application No. 20192384.4, filed on Aug. 24, 2020. The content of each of these applications is hereby incorporated by reference in its entirety.

BACKGROUND OF THE INVENTION

Field of the Invention

The invention relates to a sealing device for an edge joint between a cladding part of drywall and an adjacent floor, wall, or ceding. The invention also relates to drywall comprising at least one cladding part and at least one sealing device of this type.

Description of Related Art

Edge joints, in particular floor joints, are designed to provide sound decoupling of the drywall from adjacent walls, ceilings, or floors, in particular floorings.

The wall surfaces of the drywalls are formed by cladding parts such as gypsum boards, which often have to be protected from moisture. The edge joints therefore also form a barrier that protects the cladding parts against rising moisture, for example in the event of a pipe burst.

The edge joints are usually sprayed with a sealing compound in order to provide a sound and fire protection function and to seal the joint against air and odors.

Sealing compounds have the disadvantage that the application is time-consuming and not very ergonomic. Furthermore, sealing compounds can usually only be used reliably at temperatures of at least 5° C. and the substrate must be dry. The inspection is not easy either, since, for example, the installation depth cannot be checked non-destructively.

SUMMARY OF THE INVENTION

The object of the invention is to provide a sealing device for an edge joint of drywall, which ensures easy assembly of the sealing device and effective sealing of the edge joint.

To achieve the object, a sealing device for an edge joint is provided between a cladding part of drywall and an adjacent floor, wall, or ceiling, with a one-piece base body. The base body has a carrier portion which forms a support for the circumferential side of the cladding part, a contact portion starting from the carrier portion and protruding in a first direction angled with respect to the carrier portion in order to rest against an edge of an end face of the cladding part, and a sealing portion starting from the carrier portion and extending away from the carrier portion. The sealing portion has two spaced apart webs that bridge the edge joint.

It was recognized that a sealing device of this type can be installed with little effort. The carrier portion and the contact portion ensure that the sealing device is aligned in a defined manner on the cladding part, while the webs of the sealing portion seal and close an edge joint with a specified width. The cladding part is thus effectively protected from moisture from an adjacent floor, wall, or ceiling. Furthermore, in the direction of the joint depth, the webs of the sealing portion form two sealing planes functionally connected in series and thus provide a particularly effective seal.

DETAILED DESCRIPTION OF THE INVENTION

Figure 1:
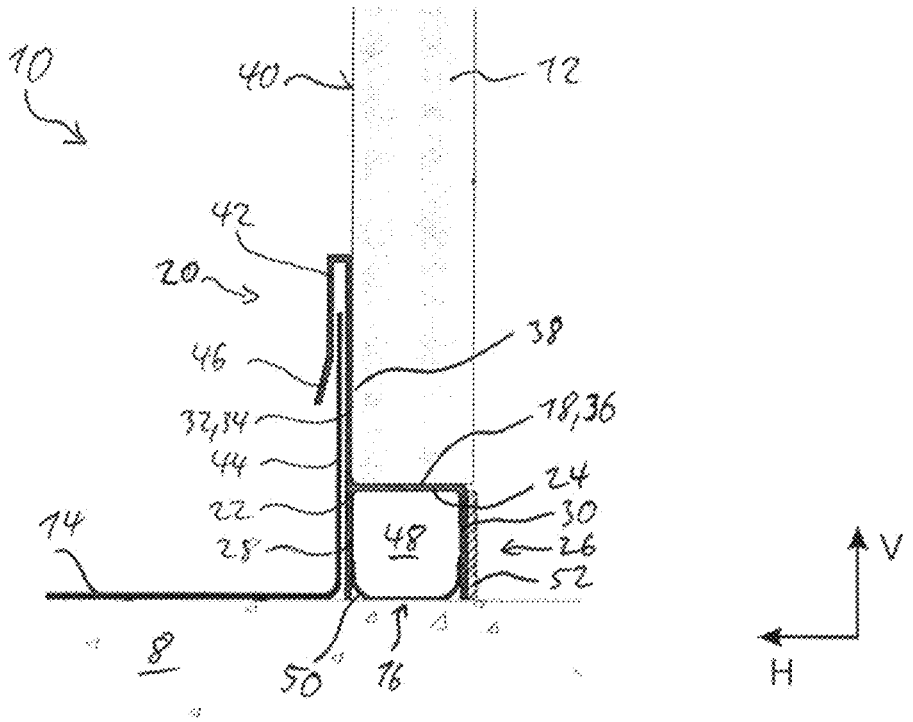
FIG. 1 is a schematic sectional view of drywall according to the invention with a sealing device according to the invention.

In one embodiment, the contact portion and one of the webs lie in one plane, as a result of which the sealing device can be designed to be particularly compact and stable.

In a further embodiment, a web extends from the opposite ends of the carrier portion, viewed in cross section. Thus, the webs extend away from the said web at the opposite ends of the carrier portion, so that the distance between the webs is particularly wide. This has the advantage that the webs can support the cladding part particularly well. This is advantageous in particular in the case of a floor joint in which the cladding part rests on the carrier portion and can be supported on the floor via the webs, for example for assembly.

It can be provided that the two webs of the sealing portion run parallel to one another when viewed in cross section. As a result, the sealing portion can be designed to be particularly stable and/or have constant sealing properties over the joint width over which the webs extend.

According to one embodiment, the sealing portion has a seal which is present between the webs. In particular, in the unloaded state, the seal protrudes from a space formed between the webs of the sealing portion. The seal merges, for example, in one piece into the webs or is formed from a different material than the webs. As a result of this design, the sealing device has a third sealing plane arranged between the two webs. The sealing effect of the sealing device can thus be improved without the installation space requirement of the sealing device increasing.

Furthermore, the sealing portion can have an intumescent seal which is present between the webs. As a result, the intumescent seal is arranged in a particularly protected manner, so that damage to the intumescent seal is avoided, especially in logistics or during assembly. In this way, a particularly reliable sealing effect can be ensured, in particular over the entire length of the sealing device and thus over the entire length of the edge joint.

According to a further embodiment, at least one of the webs branches out in a V-shape in cross section near a free end so as to form a sealing lip. The sealing lip provides a further sealing plane. Furthermore, the sealing lip can be designed in such a way that it has a particularly high sealing effect, in particular due to its shape and/or its material.

At its free end, the contact portion can form a U-shaped clip portion, viewed in cross section, which clip portion is open in the direction of the webs. The clip portion is provided for the purpose of attaching the sealing device to an on-site holding rail. In this way, the sealing device can be installed quickly, reliably, and in a defined manner without additional fastening means.

Additionally or alternatively, the sealing device, in particular the base body, can be an H-profile in which the carrier portion forms the central web, and two webs form the sealing portion, and two oppositely running webs form the contact portion. The cladding part can be received between the webs of the contact portion. This has the advantage that the sealing device is reliably aligned in a defined manner with respect to the cladding part.

In this case, it can be provided that at least one of the webs of the contact portion runs outwards to its free end in order to form an insertion bevel for the cladding part and/or that, in the region of their free end, the two webs of the contact portion run in portions towards one another and again away from one another in order to form a clamping zone for the cladding part. In this way, the sealing device can be pushed onto the cladding part and/or fastened to it with little effort, in particular without tools and without fastening means.

In an alternative embodiment, the sealing device, in particular the base body, is an h-profile in which the carrier portion forms the central web and at least two webs form the sealing portion and an oppositely running web forms the contact portion. In comparison to an H-profile, one side of the profile does not have a web in this design and is therefore open. This has the advantage that the cladding part can be placed or pushed onto the carrier portion via the open side, as a result of which the assembly can be made more flexible, in particular in narrow spaces.

The sealing device is preferably an extrusion profile, as a result of which the sealing device can be produced with little effort and in any length.

In an alternative embodiment, at least part of the sealing device can be an extrusion profile, in particular the base body.

According to the invention, drywall comprising at least one cladding part and at least one sealing device according to the invention with the aforementioned advantages is also provided to achieve the above-mentioned object. The cladding part rests with its circumferential side against the carrier portion and the sealing portion rests against the adjacent floor, wall, or ceiling. In this way, the edge joint, which is formed between the at least one cladding part and the adjacent floor, wall, or ceiling, can be sealed reliably and with little effort by the sealing device.

In one embodiment, the drywall has a sealing device in which, at its free end, the contact portion forms a U-shaped clip portion, viewed in cross section, which clip portion is open in the direction of the webs, as well as a holding rail fastened on-site, which holding rail protrudes from the floor, wall, or ceiling and which is inserted into the clip portion.

Figure 2:
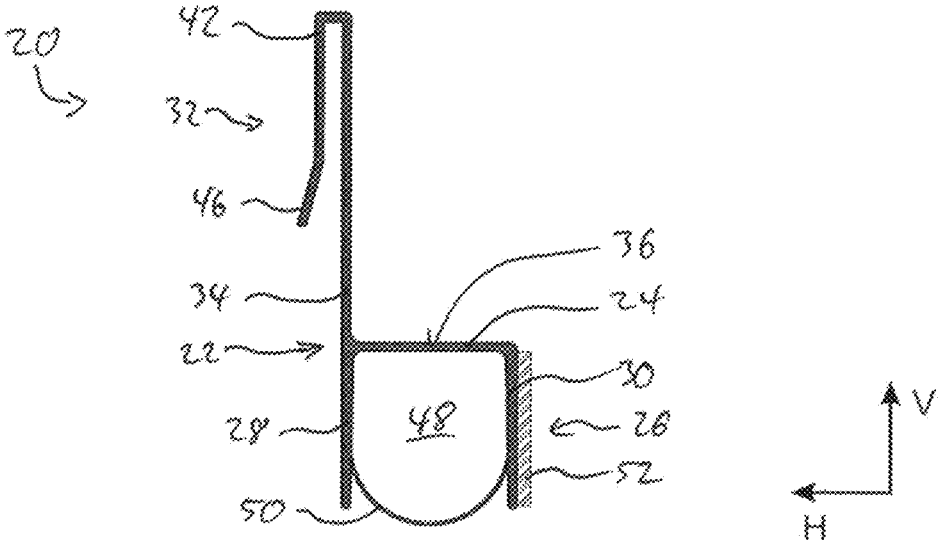
FIG. 2 is a schematic sectional view of the sealing device from FIG. 1.
Figure 3:
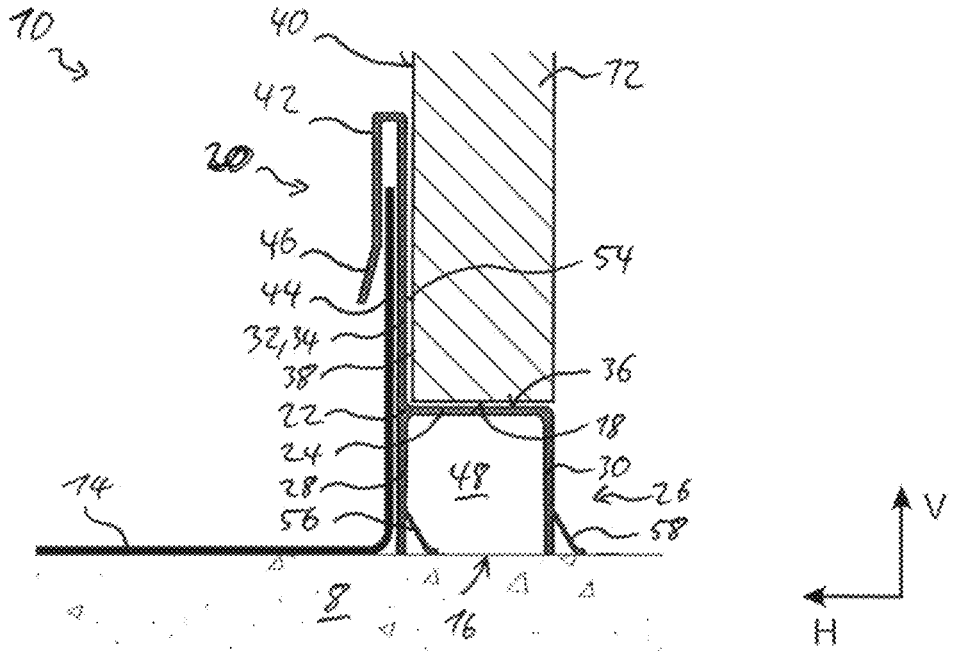
FIG. 3 is a schematic sectional view of drywall according to the invention with a sealing device according to the invention in accordance with a further embodiment.
Figure 4:
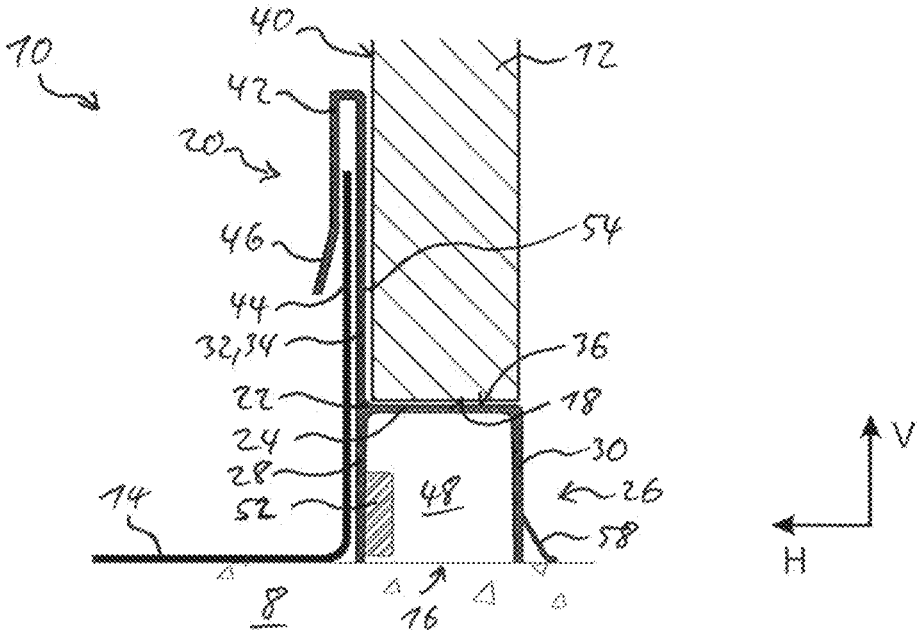
FIG. 4 is a schematic sectional view of drywall according to the invention with a sealing device according to the invention in accordance with a further embodiment.

Additionally or alternatively, the sealing device, in particular the base body, can be an H-profile and the cladding part can be inserted between two webs of the contact portion. Further advantages and features emerge from the following description and from the accompanying drawings. In the drawings:

FIG. 1 is a schematic sectional view of drywall according to the invention with a sealing device according to the invention, FIG. 2 is a schematic sectional view of the sealing device from FIG. 1, FIGS. 3 and 4 are in each case a schematic sectional view of drywall according to the invention with a sealing device according to the invention in accordance with a further embodiment, and FIGS. 5 to 8 are in each case a schematic sectional view of further embodiments of sealing devices according to the invention in accordance with further embodiments including drywalls according to the invention.

FIG. 1 is a cross section of drywall 10 with a cladding part 12 (gypsum wall) and a holding rail 14, which is part of a stand construction of the drywall 10.

In the present case, the holding rail 14 is a floor profile that is firmly anchored on the floor 8, for example by means of dowels.

The cladding part 12 is attached to the stand construction at a distance from the floor 8, as a result of which an edge joint 16 in the form of a floor joint is formed between a circumferential side 18 of the cladding part 12 and the floor 8.

In order to seal the edge joint 16, the drywall 10 also has a sealing device 20, the structure of which is described below with reference to FIG. 2. The sealing device 20 is also suitable for sealing the edge joint 16 between drywall 10 and the ceiling and/or wall.

The sealing device 20 has a one-piece base body 22 having a planar carrier portion 24, a sealing portion 26 which comprises a first web 28 and a second web 30 which extend at right angles away from the carrier portion 24 at opposite ends of the carrier portion 24, and a contact portion 32, which comprises a third web 34, which extends opposite to the first web 28 at right angles away from the carrier portion 24. The first web 28 and the third web 34 are arranged in this case at the same end of the carrier portion 24 and are therefore in one plane.

As a result, the base body 22 has an h-shaped profile which runs over the entire length of the straightening device 20.

The carrier portion 24 forms, on its side opposite to the sealing portion 26, a support 36 on which the cladding part 12 rests with its circumferential side 18 (see FIG. 1).

The edge 38 of the inner end face 40 of the cladding part 12 adjacent to the circumferential side 18 rests against the third web 34.

At the end of the third web 34 opposite the carrier portion 24, the contact portion 32 has a clip portion 42, by means of which the sealing device 20 is fastened to a side cheek 44 of the holding rail 14.

The clip portion 42 has a U-shaped cross section which is open at the bottom, as a result of which the sealing device 20 can be attached to the side cheek 44 counter to the vertical direction V.

In this case, the clip portion 42 is designed to be particularly long in the vertical direction V, so that the sealing device 20 can be attached to holding rail 14 with side cheeks 44 of different heights and at the same time rests with its sealing portion 26 against the floor 8 in order to reliably seal the edge joint 16.

The clip portion 42 also has an insertion bevel 46 in order to simplify the attachment of the sealing device 20 onto the holding rail 14.

The first and second webs 28, 30 extend in the installed state (see FIG. 1) from the carrier portion 24 counter to the vertical direction V to the floor 8 and in this way form two sealing planes which are spaced apart from one another in the horizontal direction H.

Between the two webs 28, 30 of the sealing portion 26, a space 48 is thus present which is closed on one side by the carrier portion 24.

The sealing portion 26 has a seal 50 having an arched profile which extends between the opposite sides of the two webs 28, 30 of the sealing portion 26 and protrudes at the bottom over the webs 28, 30 from the space 48 in the unloaded state (see FIG. 2). In the installed state (see FIG. 1), the seal 50 rests against the floor 8 in a resilient manner and under prestress, whereby a particularly high sealing effect is achieved.

In this case, the seal 50 is formed in one piece with the webs 28, 30 of the sealing portion 26 and thus consists of the same material as said webs.

In an alternative embodiment, the seal 50 can be formed from a different material than the webs 28, 30 of the sealing portion 26, in particular a material with a lower strength.

The sealing portion 26 also has, as a fire protection function, an intumescent strip 52 attached to the side of the second web 30 opposite to the space 48.

The sealing device 20 is an extruded profile which is produced by means of 2-component extrusion.

The base body 22 consists of a plastics material, for example EPDM, PVC, foam rubber, thermoplastic elastomer, or silicone.

In an alternative embodiment, the base body 22 can have a composite structure, for example a metal core with an outer casing made of plastics material.

In principle, the sealing device 20 can be made of any material and in any way. However, at least the base body 22 is preferably an extruded profile.

In order to reliably seal the edge joint 16 with the sealing device 20, the sealing device 20 is attached with the clip portion 42 to the holding rail 14 during the assembly of the drywall 10, which holding rail is preferably anchored to the floor 8 prior to this step.

The sealing device 20 is designed in such a way that it does not hinder the assembly of vertical uprights of the stand construction of the drywall 10. This means that the vertical uprights can be installed after the sealing device 20 has been attached to the holding rail 14.

The cladding part 12 is now set up with its circumferential side 18 on the carrier portion 24 so that the edge 38 of the end face 40 rests against the contact portion 32 and the sealing portion 26 is pressed against the floor 8, and it is then fastened to the stand construction of the drywall 10.

By placing the cladding part 12 on the sealing device 20 during assembly, it is ensured that the edge joint 16 has a defined width, while the weight of the cladding part 12 ensures that the sealing portion 26 rests sealingly against the floor 8.

In principle, the sealing device 20 can be formed to seal any edge joint 16 between a circumferential side 18 of the cladding part 12 and an adjacent floor, wall, or ceiling.

A sealing device according to a further embodiment will now be described with reference to FIG. 3. The same reference signs are used for the components which are known from the above embodiment and in this respect reference is made to the preceding explanations.

In contrast to the sealing device 20, which is shown in FIGS. 1 and 2, the base body 22 has a sealing rib 54 protruding laterally from the contact portion 54, which sealing rib is configured to seal the gap between the contact portion 32 and the edge 38 of the inner end face 40 of the cladding part 12.

Furthermore, instead of the seal 50, the sealing portion 26 has a first sealing lip 56 and a second sealing lip 58 which rest sealingly against the floor 8.

The ends of the first and second webs 28, 30, which ends are at the bottom, in this embodiment each have a V-shaped cross section which spreads open towards the floor 8.

The first sealing lip 56 is thereby formed by the leg of the "V" of the first web 28, which web faces the space 48, while the second sealing lip 58 is formed by the leg of the "V" of the second web 30, which web faces away from space 48.

Furthermore, no intumescent strip 52 is provided in the embodiment shown, but this can also be different.

A sealing device according to a further embodiment will now be described with reference to FIG. 4. The same reference signs are used for the components which are known from the above embodiments and in this respect reference is made to the preceding explanations.

In contrast to the embodiment shown in FIG. 3, instead of the first sealing lip 56, the sealing device 20 has an intumescent strip 52 which is attached to the first web 28 in a protected manner in the space 48.

Figure 5:
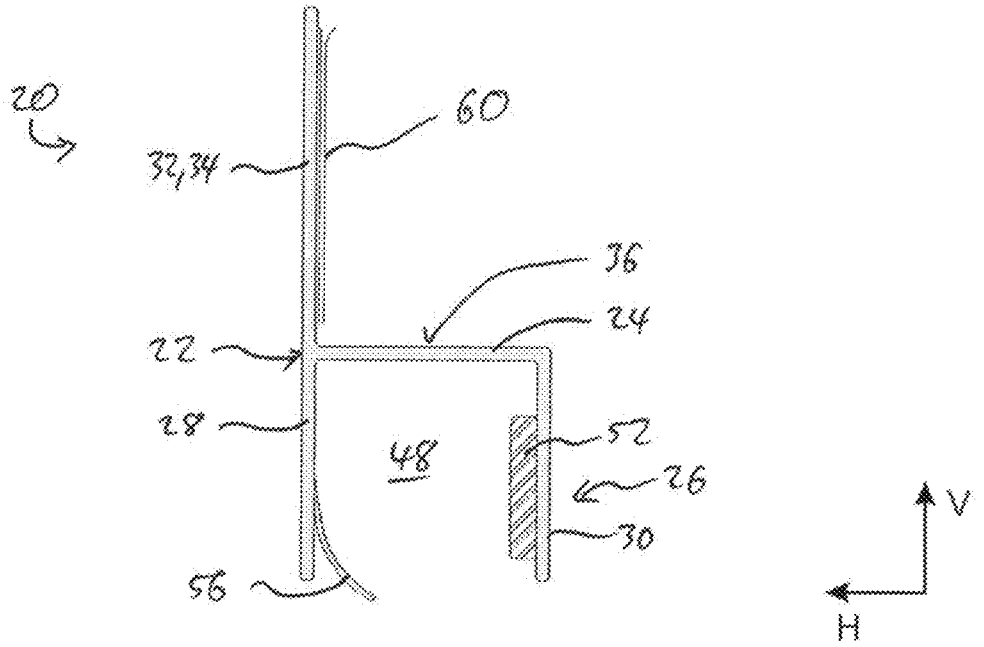
FIG. 5 is a schematic sectional view of a further embodiment of a sealing device according to the invention in accordance with a further embodiment including drywall according to the invention.

A sealing device according to a further embodiment will now be described with reference to FIG. 5. The same reference signs are used for the components which are known from the above embodiments and in this respect reference is made to the preceding explanations.

In this embodiment, in addition to a sealing lip 56 on the first web 28, the sealing device 20 has an intumescent strip 52 which is attached to the second web 30 in the space 48. As a result of this design, both the sealing lip 56 and the intumescent strip 52 are arranged in a protected manner.

The sealing lip 56 is designed to be excessively long compared to the webs 28, 30.

Furthermore, instead of the clip portion 42, the sealing device 20 has an adhesive strip 60 which is attached to the side of the third web 34 facing the carrier portion 24.

When assembling the drywall 10, the sealing device 20 is fastened to the cladding part 12 and not to the holding rail 14. In this case, the sealing device 20 is bonded to the edge 38 of the inner end face 40 of the cladding part 12 by means of the adhesive strip 60 in such a way that the circumferential side 18 rests against the carrier portion 24. Subsequently, the cladding part 12 is fastened together with the sealing device 20 to the stand construction of the drywall 10.

In order to reliably attach the sealing device 20 to the cladding part 12, the contact portion 32 can additionally be fastened to the cladding part 12 by means of clips.

According to a further embodiment, the sealing device 20 can of course be provided to be fastened to the cladding part 12 by means of clips. In this case, the adhesive strip 60 can be omitted.

Furthermore, in all embodiments, the adhesive strip 60 can be provided in addition to a fastening device, in particular a clip portion 42. In this case, the adhesive strip 60 can additionally or alternatively be used for fastening, as a result of which the sealing device 20 can be used more flexibly.

In addition, the adhesive strip 60 can be provided as a sealing element to seal the gap between the contact portion 32 and the edge 38 of the inner end face 40 of the cladding part 12.

A sealing device according to a further embodiment will now be described with reference to FIG. 6. The same reference signs are used for the components which are known from the above embodiments and in this respect reference is made to the preceding explanations.

In contrast to the previous embodiments, the sealing device 20 has a sealing portion 26 having a further web 62, i.e. the sealing portion comprises three webs 28, 30, 62.

The further web 62 extends parallel to and equidistant from the webs 28, 30 away from the carrier portion 24 and in this way divides the space 48.

The three webs 28, 30, 62 of the sealing portion 26 have the same height in the vertical direction V and form three sealing planes in the horizontal direction H.

Furthermore, the webs 28, 30, 62 of the sealing portion 26 and the carrier portion 24 have a wall thickness that is twice as great as the wall thickness of the contact portion 32 or of the third web 34.

In principle, the webs 28, 30, 62 of the sealing portion 26 and the carrier portion 24 can have any wall thickness, in particular a wall thickness that is greater than the wall thickness of the contact portion 32 or the third web 34.

As a result, the webs 28, 30, 62 of the sealing portion 26 have a higher sealing effect and have improved fire protection properties, so that additional fire protection elements, such as intumescent strips 52, can be dispensed with in the case of low fire protection requirements.

Figure 6:
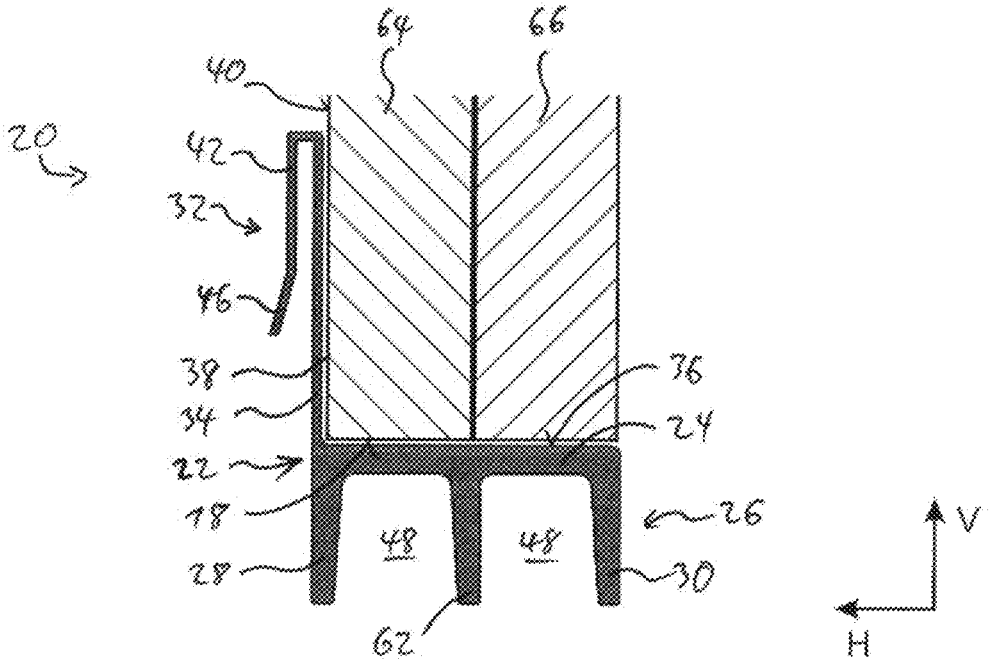
FIG. 6 is a schematic sectional view of a further embodiment of a sealing device according to the invention in accordance with a further embodiment including drywall according to the invention.

The sealing device 20 shown in FIG. 6 is provided for drywall 10 having double-layer cladding. This means that, adjacent to the stand construction, the drywall 10 has an inner first cladding part 64 and, adjacent to the first cladding part 64, the drywall has a second cladding part 66 that forms the outer side of the drywall 10.

For this purpose, the support 36 has a width in the horizontal direction H which corresponds to twice the wall thickness of a cladding part 12, 64, 66.

Of course, the sealing device 20 can be provided in an alternative embodiment for drywall 10 having single-layer cladding. In this case, the support 36 has a width in the horizontal direction H which corresponds to the wall thickness of a cladding part 12, 64, 66.

A sealing device according to a further embodiment will now be described with reference to FIG. 7. The same reference signs are used for the components which are known from the above embodiments and in this respect reference is made to the preceding explanations.

Figure 7:
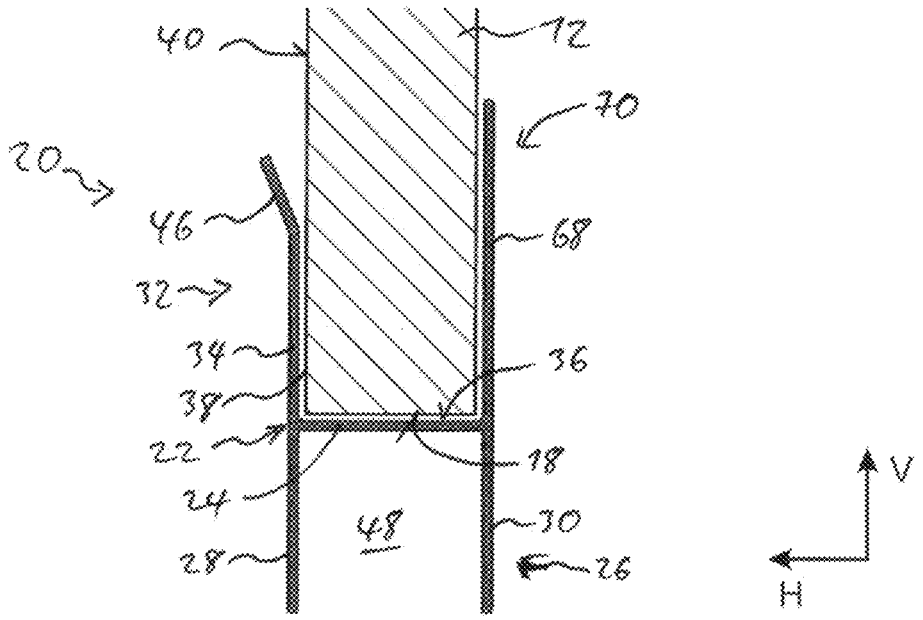
FIG. 7 is a schematic sectional view of a further embodiment of a sealing device according to the invention in accordance with a further embodiment including drywall according to the invention.

The sealing device 20 shown in FIG. 7 has a contact portion 32 with a fourth web 68 which, opposite to the second web 30, extends at right angles away from the carrier portion 24. The second web 30 and the fourth web 68 are arranged in this case at the same end of the carrier portion 24 and are therefore in one plane.

As a result, the base body 22 has an H-shaped profile.

In this case, the two webs 34, 68 of the contact portion 32 form a holding portion 70 which can be placed on the circumference of a cladding part 12 in order to fasten the sealing device 20 to the cladding part 12.

The distance between the two webs 34, 68 of the contact portion 32 in the horizontal direction H corresponds to the wall thickness of the cladding part 12.

In order to make the attachment easier, the third web 34 has an insertion bevel 46.

When assembling the drywall 10, the sealing device 20 is fastened to the cladding part 12 by means of the holding portion 70. The sealing device 20 is pushed onto the cladding part 12 until the circumferential side 18 rests against the carrier portion 24. Subsequently, the cladding part 12 is fastened together with the sealing device 20 to the stand construction of the drywall 10.

Figure 8:
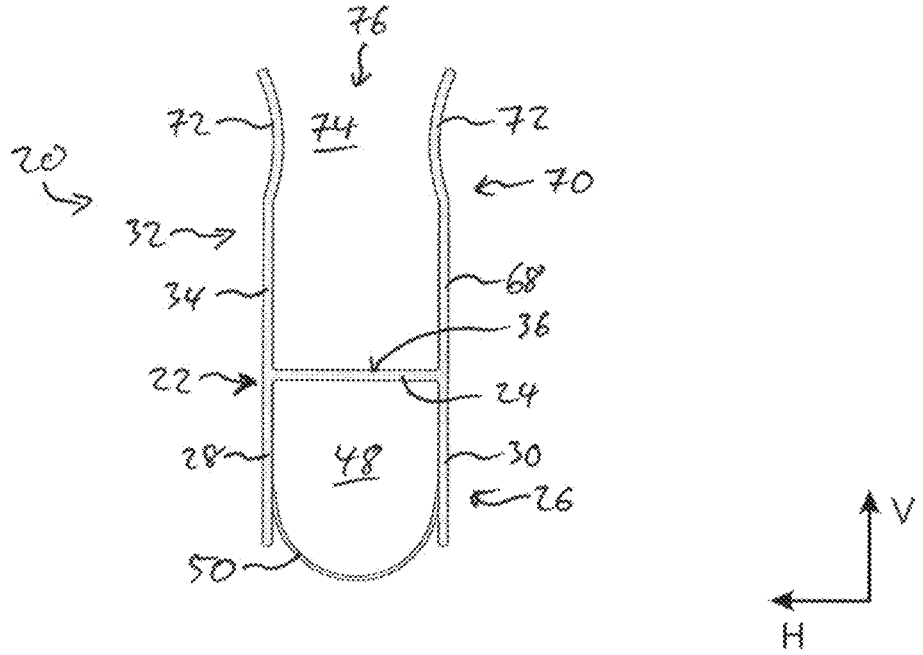
FIG. 8 is a schematic sectional view of a further embodiment of a sealing device according to the invention in accordance with a further embodiment including drywall according to the invention.

A sealing device according to a further embodiment will now be described with reference to FIG. 8. The same reference signs are used for the components which are known from the above embodiments and in this respect reference is made to the preceding explanations.

In contrast to the embodiment shown in FIG. 7, the holding portion 70 has two arched clamping jaws 72 which extend in the vertical direction V away from the ends of the webs 34, 68 of the contact portion 32, which ends are arranged opposite to the carrier portion 24, and initially run in the horizontal direction H towards each other and then again away from one another.

A clamping zone 74 is thus formed between the two clamping jaws 72, in which a cladding part 12 is clamped when the sealing device 20 is attached to the cladding part 12, In this way, the sealing device 20 can be reliably fastened to the cladding part 12.

The free ends of the clamping jaws 72 bent away from one another also form an insertion opening 76 which makes the attachment of the sealing device 20 easier.

In this way, a sealing device 20 is provided for an edge joint 16 of drywall 10, which in all embodiments ensures easy assembly of the sealing device 20 combined with the erection of the stand construction.

Furthermore, the sealing portion 26 ensures that the edge joint 16 is effectively sealed with respect to air and sound.

The sealing device 20 turns the drywall 10 into a fire-safe construction, by means of which smoke, temperature, and fire can be prevented from spreading over to the side of the drywall 10 that faces away from the fire.

The webs 28, 30 of the sealing portion 26 ensure a defined joint width and also protect the cladding part 12 against moisture in or on the floor 8, in particular during the construction phase.

Furthermore, the sealing device 20 is a factory-made application solution with constant properties, which makes the sealing of edge joints with a consistently high quality easier.

The invention is not limited to the embodiments shown. In particular, individual features of one embodiment can be combined in any way with features of other embodiments, in particular independently of the other features of the corresponding embodiments.

For example, all of the sealing elements shown in the different embodiments, such as the webs 28, 30, 62, the seal 50, the intumescent strip 52, the sealing rib 54 and the sealing lips 56, 58, can be combined in any number and in any way in a further embodiment.

Furthermore, each contact portion can be combined with any sealing portion.

Furthermore, each sealing device can be configured for single-layer or double-layer cladding.

The invention claimed is:

1. A sealing device for an edge joint between a cladding part of drywall and an adjacent floor, wall, or ceiling, the sealing device comprising:

a one-piece base body having a carrier portion which forms a support for a circumferential side of the cladding part, a contact portion starting from the carrier portion and protruding in a first direction angled with respect to the carrier portion in order to rest against an edge of an end face of the cladding part, and a sealing portion starting from the carrier portion and extending away from the carrier portion, wherein the sealing portion has two spaced apart webs which bridge the edge joint, the contact portion and one of the two spaced apart webs lie in one plane, and at a free end, the contact portion forms a U-shaped clip portion, viewed in cross section, wherein the clip portion is open in a direction of the two spaced apart webs for attaching the sealing device on an on-site holding rail.

2. The sealing device according to claim 1, wherein a web of the two spaced apart webs extends from opposite ends of the carrier portion, viewed in cross section.

3. The sealing device according to claim 1, wherein the two spaced apart webs of the sealing portion run parallel to one another.

4. The sealing device according to claim 1, wherein the sealing portion has a seal which is present between the two spaced apart webs.

5. The sealing device according to claim 1, wherein the sealing portion has an intumescent seal which is present between the two spaced apart webs.

6. The sealing device according to claim 1, wherein at least one of the two spaced apart webs branches out in a V-shape, viewed in cross section, near a free end so as to form a sealing lip.

7. The sealing device according to claim 1, wherein the sealing device is an H-profile in which the carrier portion forms a central web, wherein the two spaced apart webs form the sealing portion, wherein two oppositely running webs form the contact portion, and wherein the cladding part can be received between the two oppositely running webs of the contact portion.

8. The sealing device according to claim 7, wherein each of the two oppositely running webs has a free end, wherein at least one of the two oppositely running webs of the contact portion runs outwards to the free end in order to form an insertion bevel for the cladding part, and/or wherein, in a region of the free end, the two oppositely running webs of the contact portion run in portions towards one another and again away from one another in order to form a clamping zone for the cladding part.

9. The sealing device according to claim 1, wherein the sealing device is an h-profile, in which the carrier portion forms a central web, wherein at least the two spaced apart webs form the sealing portion, and wherein an oppositely running web forms the contact portion.

10. The sealing device according to claim 1, wherein the sealing device is an extrusion profile.

11. Drywall, comprising:

at least one cladding part, and at least one sealing device according to claim 1, wherein the at least one cladding part rests with a circumferential side against the carrier portion, and wherein the sealing portion rests against the adjacent floor, wall, or ceiling.

12. The drywall according to claim 11, wherein at a free end, the contact portion forms a U-shaped clip portion, viewed in cross section, wherein the clip portion is open in a direction of the two spaced apart webs, and wherein a holding rail fastened on-site is present, wherein the holding rail protrudes from the floor, wall, or ceiling, and is inserted into the clip portion.

13. The drywall according to claim 11, wherein the sealing device is an H-profile and the at least one cladding part is inserted between two webs of the contact portion.

14. The sealing device according to claim 4, wherein the seal, in an unloaded state, protrudes from a space formed between the two spaced apart webs.

15. The sealing device according to claim 4, wherein the seal merges in one piece into the two spaced apart webs, or wherein the seal is formed from a different material than the two spaced apart webs.

* * * * *